US005501002A

United States Patent [19]

Fukami

[11] Patent Number: 5,501,002

[45] Date of Patent: Mar. 26, 1996

[54] TAG FASTENING DEVICE

[76] Inventor: Syouichi Fukami, 2-3-8-825 Minamisuna Koutou-ku, Tokyo, Japan

[21] Appl. No.: 262,618

[22] Filed: Jun. 20, 1994

[51] Int. Cl.[6] ..... B25B 25/00

[52] U.S. Cl. ..... 29/811.2; 29/235; 227/18; 227/67

[58] Field of Search ..... 227/15, 16, 17, 227/18, 67, 118, 119, 120, 141, 144; 29/235, 241, 244, 267, 268, 432, 433, 450, 453, 811.2; 128/330; 24/704.1, 704.2

[56] References Cited

U.S. PATENT DOCUMENTS

| | | | |
|---|---|---|---|
| 4,445,882 | 5/1984 | Ueno | 227/67 X |
| 4,483,066 | 11/1984 | Akira | 227/15 X |
| 4,535,926 | 8/1985 | Furutsu | 227/67 |
| 4,536,933 | 8/1985 | Furutsu | 227/18 X |
| 4,538,754 | 9/1985 | Furutsu | 227/67 |
| 4,672,966 | 6/1987 | Haas, Jr. | 227/144 X |
| 4,687,465 | 8/1987 | Prindle et al. | 227/67 X |

*Primary Examiner*—Rinaldi I. Rada
*Assistant Examiner*—Jay A. Stelacone
*Attorney, Agent, or Firm*—Frishauf, Holtz, Goodman, Langer & Chick

[57] ABSTRACT

A tag fastening device is pistol-shaped and has a grip, in which a trigger lever is pivotally mounted on a pin mounted on the inside of the grip. The trigger lever is normally urged forward by the lower end of a swing arm pivotally secured by a pin to the grip on the inside thereof and normally pulled backward by spring means. When the trigger lever is manually actuated, the upper end of the swing arm pushes forward a piston pin to guide a plug-in part of a tag fastener from a magazine, while at the same time a slide bar is pushed forward to cut the tag fastener off a fastener assembly loaded in the magazine. The plug-in part of the tag fastener is received and guided by a curved rotary feed arm to a position where to attach it to an article after passing through a hole of a tag. Then, the plug-in part is forced into an aperture of a socket formed at the opposite end of the fastener.

6 Claims, 14 Drawing Sheets

TAG FASTENING DEVICE

BACKGROUND OF THE INVENTION

The present invention relates to a tag fastening device for attaching price tags or the like to goods one by one through one-touch simple operations.

Conventionally, tag fasteners are each formed by molding and drawing or stretching a plastic material into a thin, tough and elastic one-piece filament, which has at one end a plug-in part composed of a positioning member and a stop member and at the other end an elastic socket (an aperture) for receiving the plug-in part.

A plurality of such tag fasteners, held straight, are stacked in a container open at the top, from which they are manually drawn out one by one and the plug-in part is inserted into the socket after being passed through a hole of a tag. Hence, such conventional manual work of fixing tags to goods is time-consuming and hence inefficient and, to make matters worse, it may sometimes produce pains in finger-tips.

SUMMARY OF THE INVENTION

It is therefore an object of the present invention to provide a tag fastening device which enables tag fasteners, formed as a fastener assembly, to be fastened or attached to goods one by one with one-touch simple operations to enhance the efficiency of work and hence reduce the working time and to exclude the possibility of workers suffering from pains in their fingertips.

To attain the above objective, the tag fastening device according to the present invention comprises: a case, a part of which forms a grip of the device; a magazine detachably mounted on the case, for housing a tag fastener assembly; a trigger lever pivotally secured by a pin to the grip on the inside thereof; a swing arm pivotally secured by a pin to the grip on the inside thereof and normally pulled backward by a spring to turn about the pivot pin, urging the trigger lever forward; a piston pin normally pulled backward by a coil spring wound thereon, for receiving and guiding a plug-in part of each tag fastener fed from the magazine; a slide bar operatively associated with the piston pin, for cutting the tag fastener off the tag fastener assembly held in the magazine; and a curved rotary feed arm pivotally secured to the magazine, for receiving and feeding the cut-off tag fastener, after passing it through a hole of a tag, to a position where to attach it to an article.

When the trigger lever is manually actuated, the swing arm is turned about its pivot pin against the spring force to push forward the piston pin to receive the plug-in part of the lowermost tag fastener of the tag fastener assembly from the magazine, while at the same time the slide bar is moved forward to cut the lowermost tag fastener off the tag fastener assembly. The tag fastener thus cut off is received and brought by the curved rotary feed arm to the position for attachment to the article. Then, the piston pin is further moved forward to pass the tag fastener through the hole of the tag and, for example, a belt loop of trousers and insert the plug-in part of the tag fastener into an aperture of its socket, thus attaching the tag to the article to be put on sale.

DESCRIPTION OF THE PREFERRED EMBODIMENT

Figure 38:
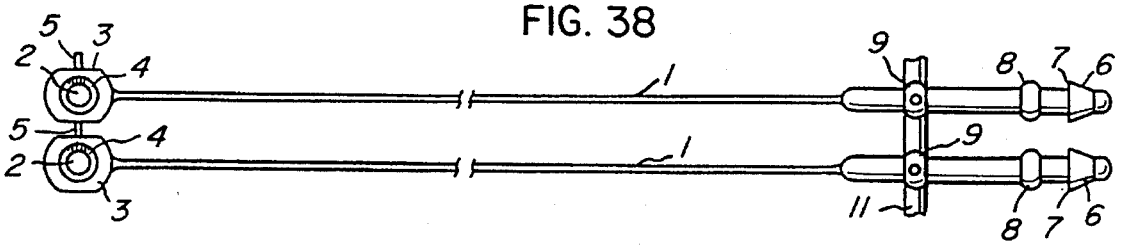
FIG. 38 is a plan view of a tag fastener assembly.
Figure 39:
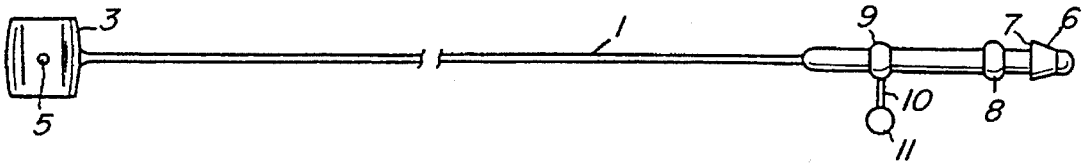
FIG. 39 is its side view.
Figure 40:
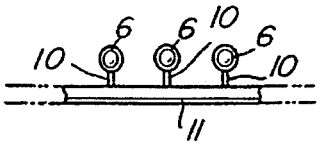
FIG. 40 is its front view.

A description will be given first, with reference to FIGS. 38 through 40, of a tag fastener assembly for use with the tag fastening device of the present invention. Reference numeral 1 denotes individual tag fasteners made of plastic; these tag fasteners 1 are elastic and tough to some extent. The tag fasteners 1 each have at one end a tubular socket 3 formed integrally therewith and having an aperture 2 for receiving a plug-in part 6 formed at the opposite end of the fastener 1. The aperture 2 has a thin annular inner flange protrusively formed on the inside thereof for locking therein the plug-in part 6 and an enlarged stop 8 described later. The sockets 3 are connected together by connecting members at fixed intervals. The thin connecting members 5 each have the axis perpendicular to that of each aperture 2. The plug-in part 6 at the other end of the respective tag fastener 1, formed integrally therewith, is substantially conical and has its base defined by a stepped portion 7 for engagement with the locking flange 4 of the aperture 2. Formed near the plug-in part 6 is the afore-mentioned enlarged stop 8. When forced into the aperture 2 of the socket 3, the plug-in part 6 pushes aside and passes through the thin annular flange or locking piece 4, locking it between the stepped portion 7 of the plug-in part 6 and the enlarged stop 8 and hence preventing the plug-in part 6 from falling out of the socket 3.

Reference numeral 9 denotes an enlarged portion for actuation use, formed at some distance from the enlarged stop 8 to prevent slipping of the tag fastener 1. The enlarged portions 9 of the respective tag fasteners 1 are coupled together by thin coupling members 10 extending therefrom and connected at one end to a support member 11, thus providing the tag fastener assembly. The tag fastener assembly thus formed is loaded into a magazine described later. The thin coupling members 10 extend in parallel to the apertures 2 and the support member 11 is perpendicular to the apertures 2, that is, parallel to the connecting members 5.

Turning next to FIGS. 1 through 37, the tag fastening device of the present invention will be described. Reference numeral 20 denotes generally a plastic case cover of the tag fastening device, which is formed by a pair of vertically divided, right and left cover halves and has housed therein a drive mechanism. The case cover 20 has a pistol-like configuration with a grip portion 21. The grip portion 21 is open in its front and has mounted therein a trigger lever 23 pivotally secured at its upper end by a pin 22.

Reference numeral 24 denotes a swing arm pivotally secured centrally thereof by a pin 25 to the grip portion 21 on the inside thereof. The swing arm 24 has a wide area end portion, which makes a sliding contact with a curved guide 26 of the trigger lever 23 to urge it forward at all times. The force that is applied to the trigger lever 23 by the swing arm 24 is produced by a coil spring 27 hooked at one end on a slide pin 28 movable along a guide formed in the grip 21 and fixed at the other end to the grip 21. The top end portion of the swing arm 24 is received by a stopper 31 at the rear of a piston pin 30 with a coil spring 29 partly wound thereon.

Figure 27:
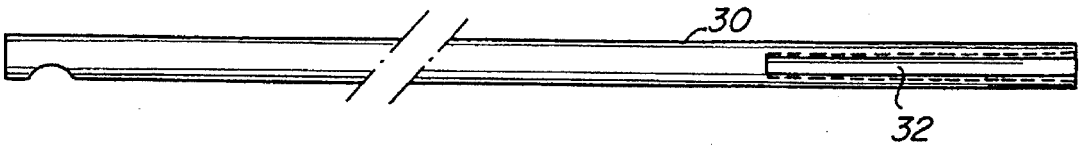
FIG. 27 is a side view of a piston pin.
Figure 28:
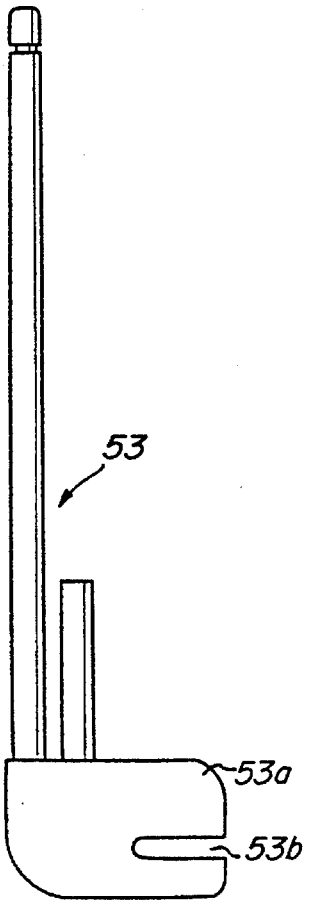
FIG. 28 is a plan view of a slide cam.
Figure 29:
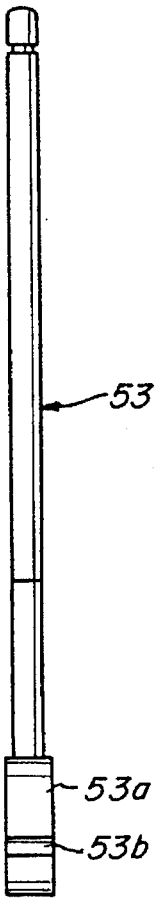
FIG. 29 is its side view.

As shown in FIG. 27, the piston pin 30 is pipe-shaped and has a slit 32 made in its forward end portion to receive a part of the tag fastener 1 when it is fastened to an article.

Figure 1:
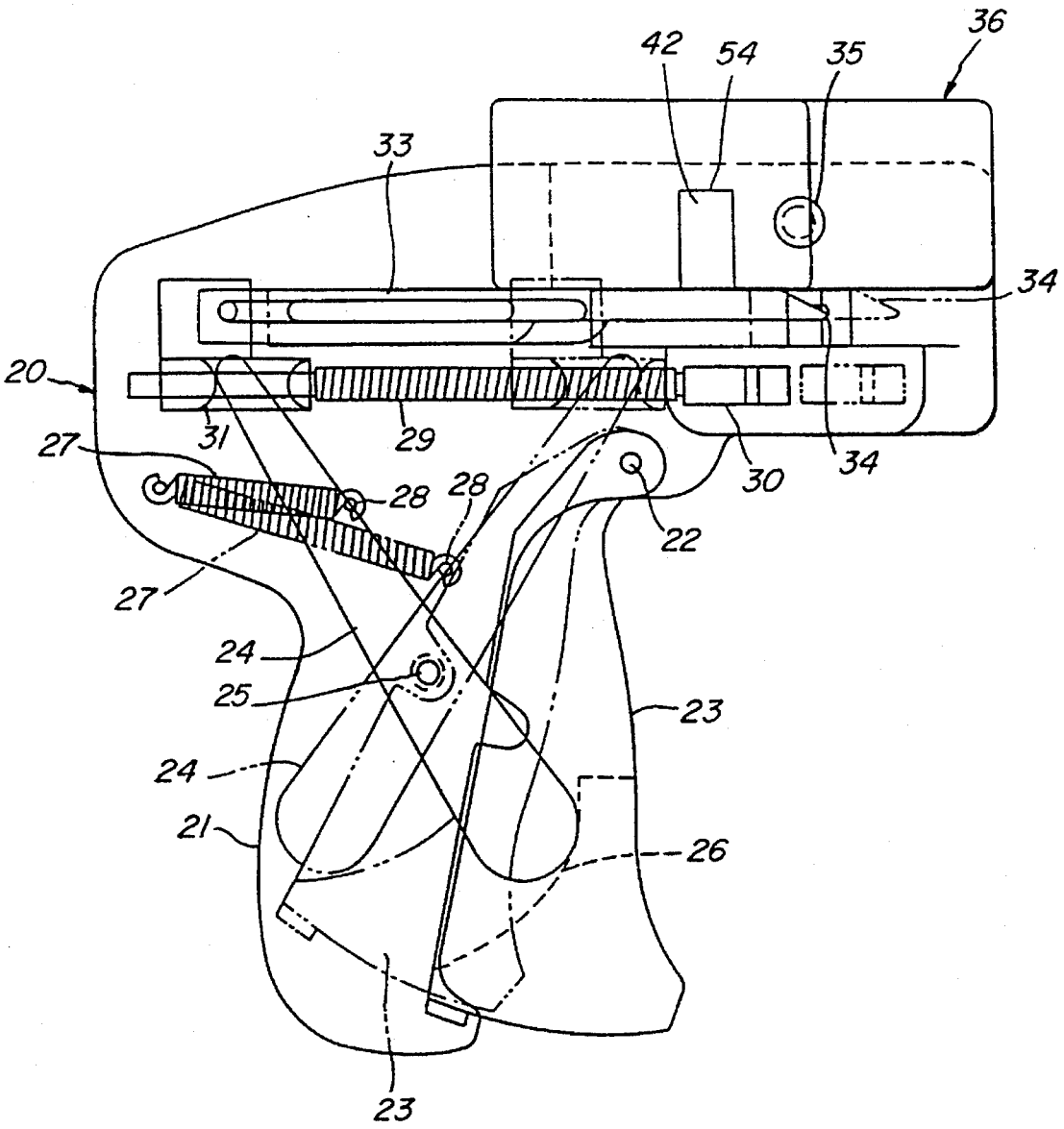
FIG. 1 is a side view illustrating the internal mechanism of the tag fastening device according to the present invention.
Figure 2:
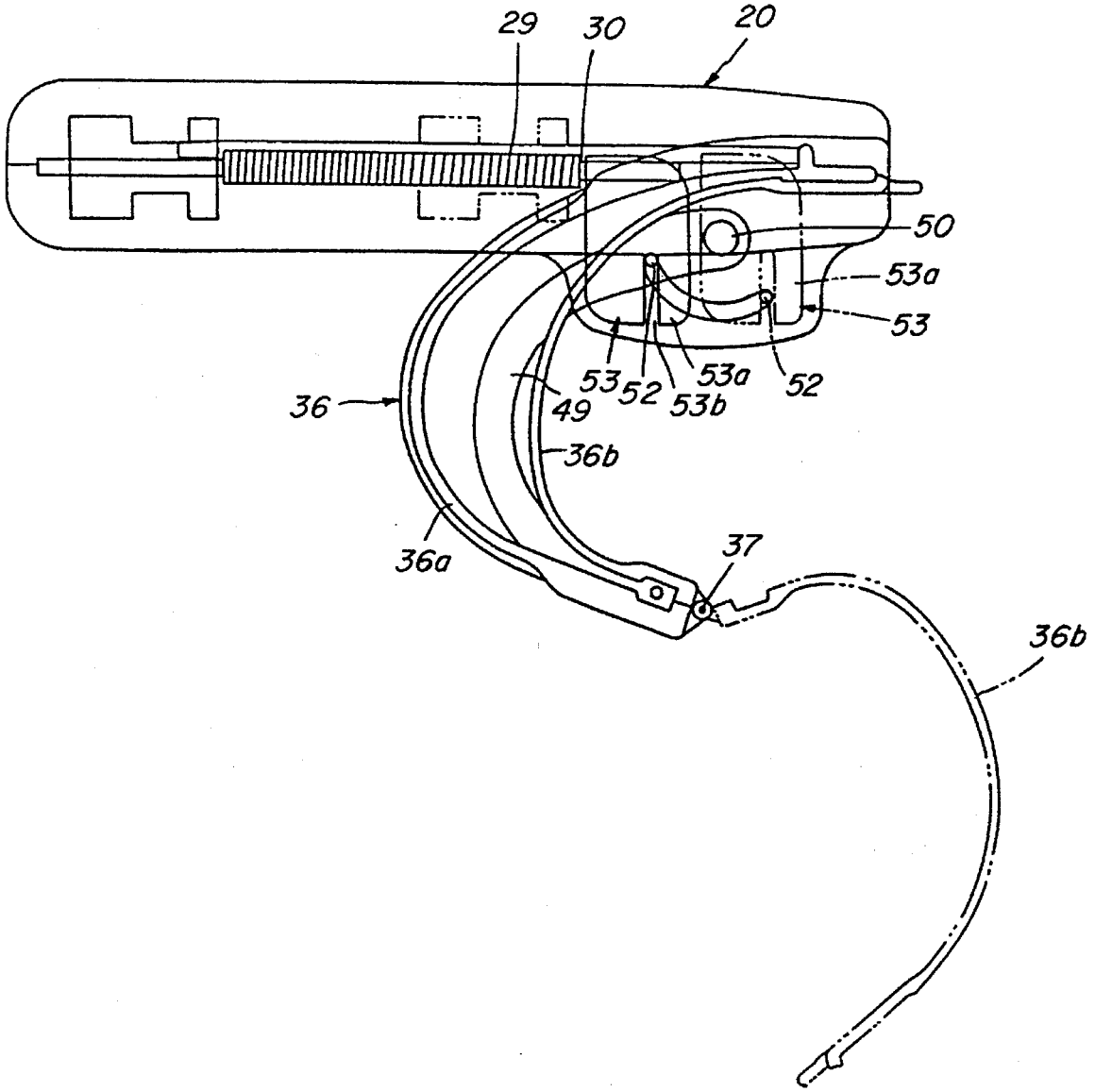
FIG. 2 is its plan view.
Figure 3:
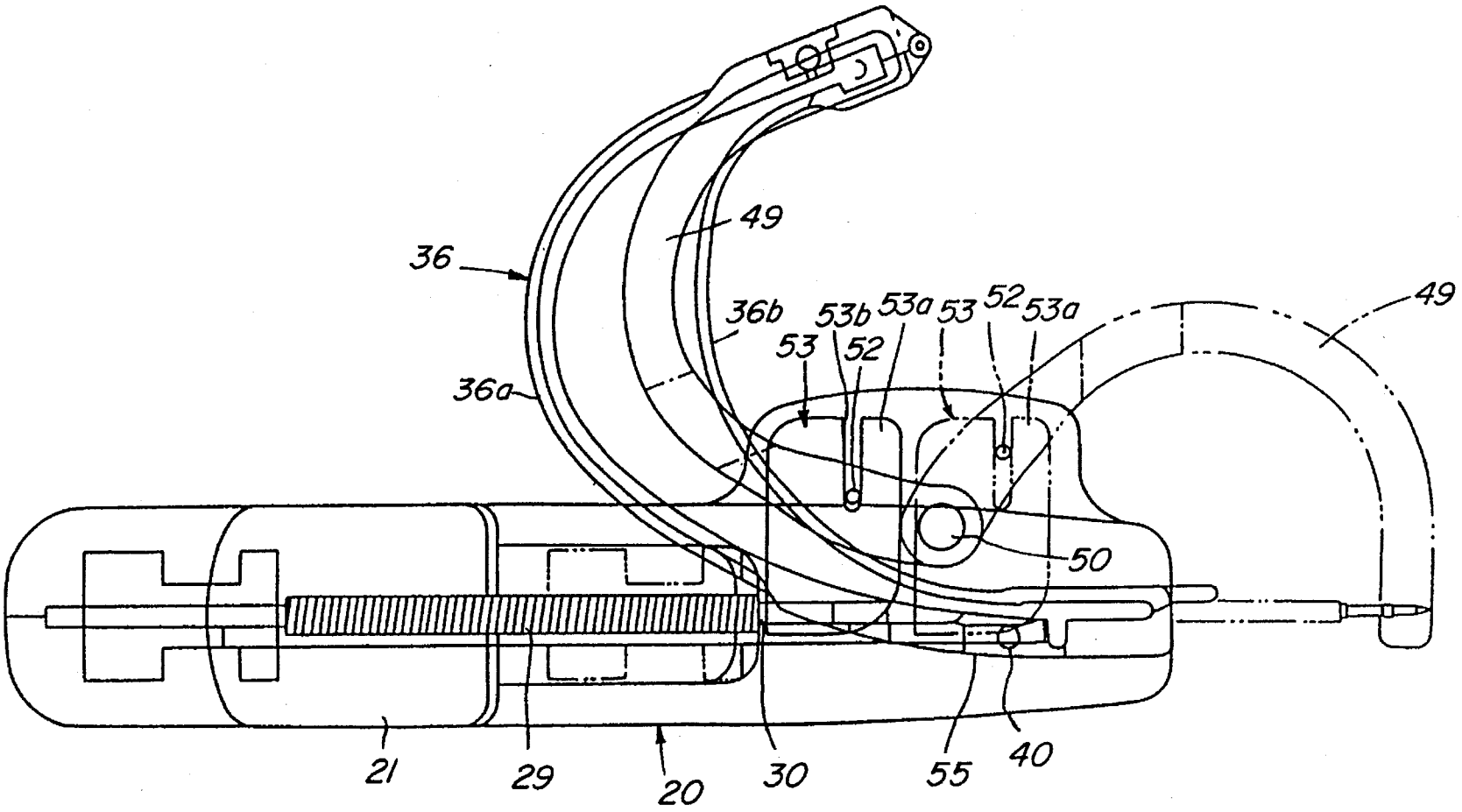
FIG. 3 is its bottom view.
Figure 4:
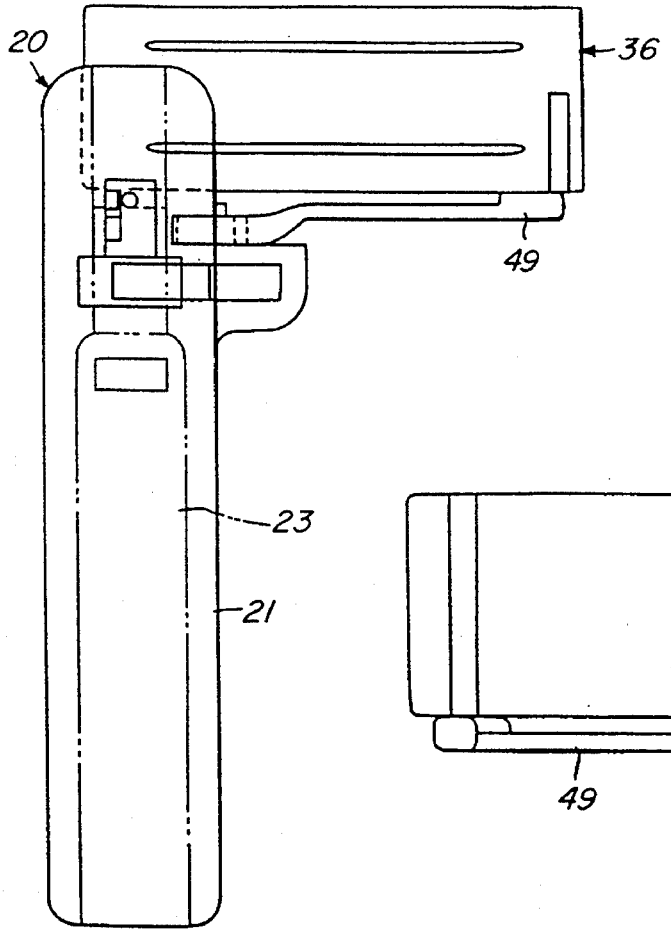
FIG. 4 is its left side view.
Figure 5:
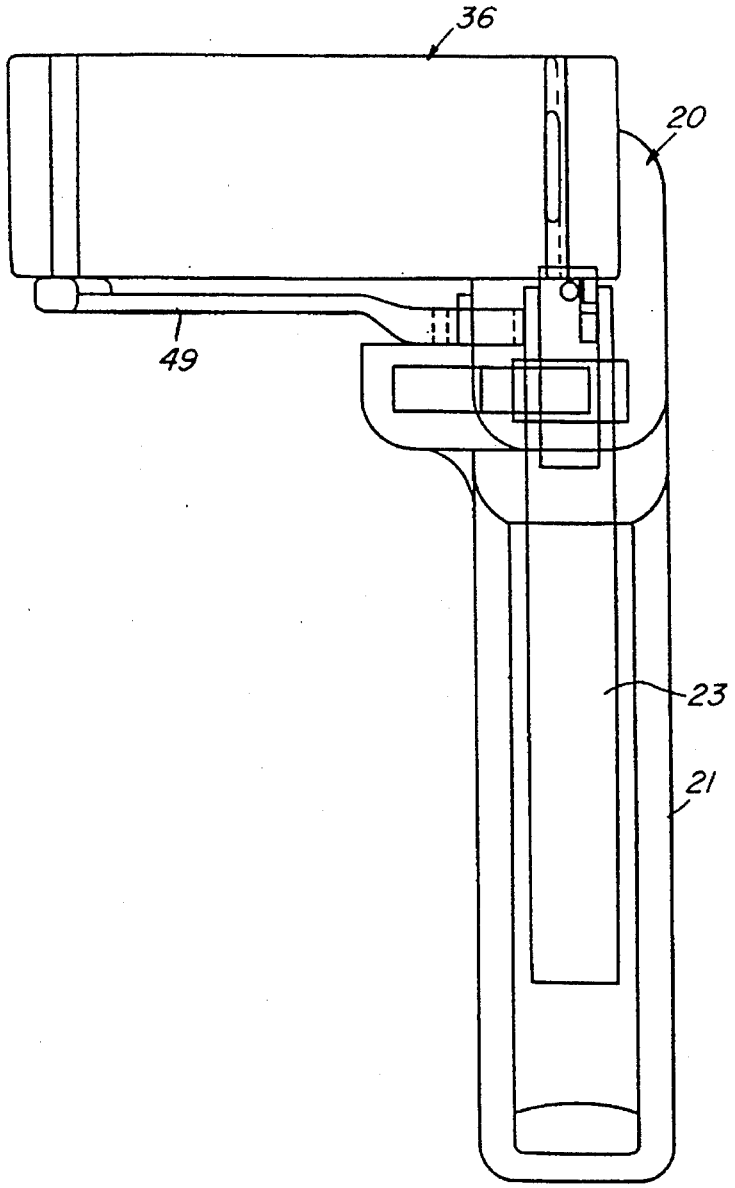
FIG. 5 is its right side view.
Figure 6:
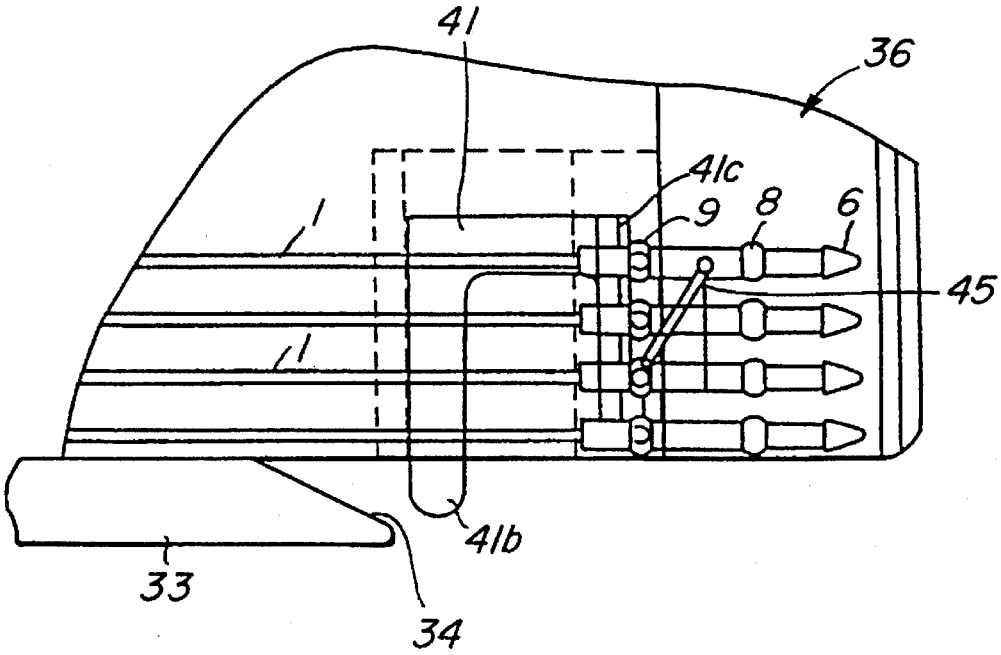
FIG. 6 is a front view showing a tag fastener feed mechanism of a tag fastener magazine.
Figure 7:
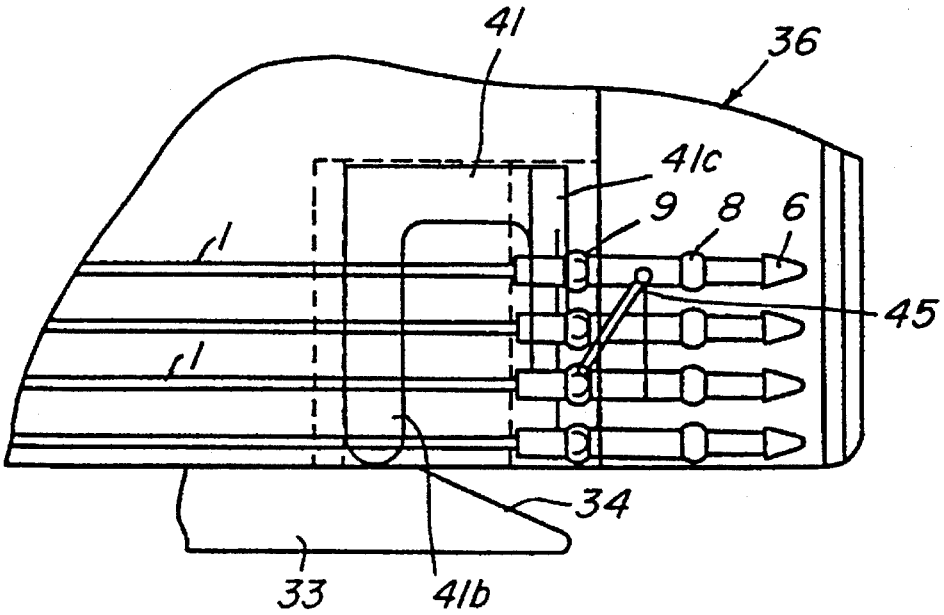
FIG. 7 is a diagram schematically showing the feed mechanism in one operative state.

In FIG. 1, reference numeral 33 denotes a slide bar operatively associated with the piston pin 30. The slide bar 33 has a tapered tip 34 which guides slide cams of the tag fastener magazine described later.

Figure 9:
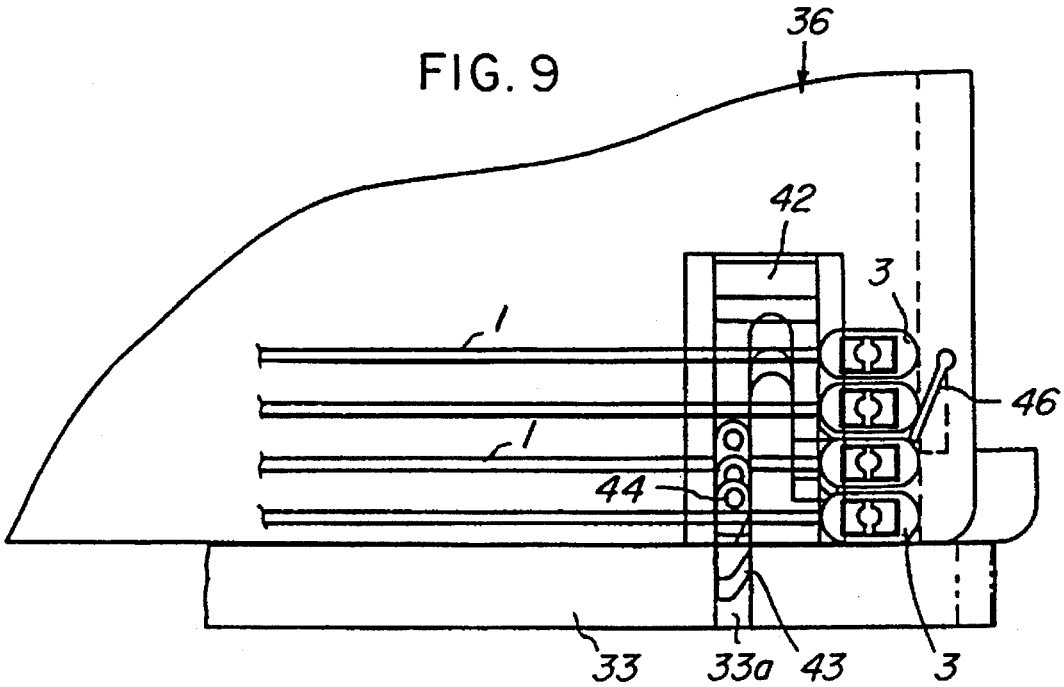
FIG. 9 is a diagram schematically showing the feed mechanism in another operative state.
Figure 10:
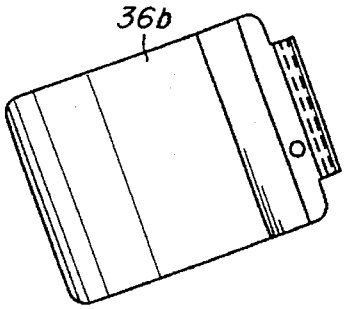
FIG. 10 is a schematic diagram of the smaller-radius-of-curvature panel viewed from its base end side.
Figure 12:
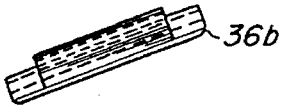
FIG. 12 is an end view of the smaller-radius-of-curvature panel at its base end side.
Figure 9A:
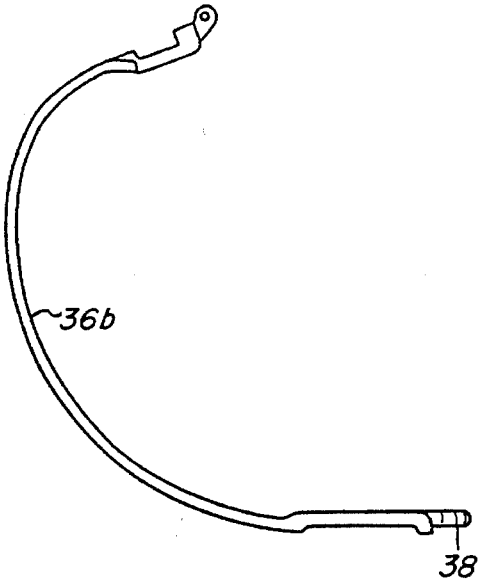
FIG. 9A is a plan view of a smaller-radius-of-curvature panel of the tag as fastener magazine.
Figure 13:
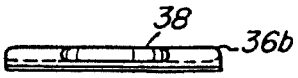
FIG. 13 is an end view of the smaller-radius-of-curvature panel at its free end side.
Figure 11:
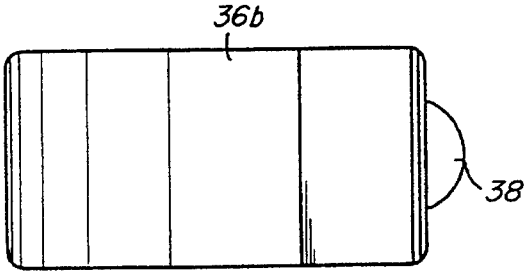
FIG. 11 is a schematic diagram of the smaller-radius-of-curvature panel viewed from its free end side.
Figure 15:
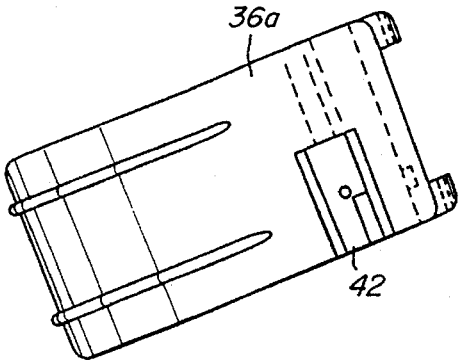
FIG. 15 is a schematic diagram of the larger-radius-of-curvature panel viewed from its base end side where it is coupled to the smaller-radius-of-curvature panel.
Figure 17:
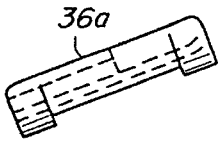
FIG. 17 is an end view of the larger-radius-of-curvature panel at its base end side.
Figure 14:
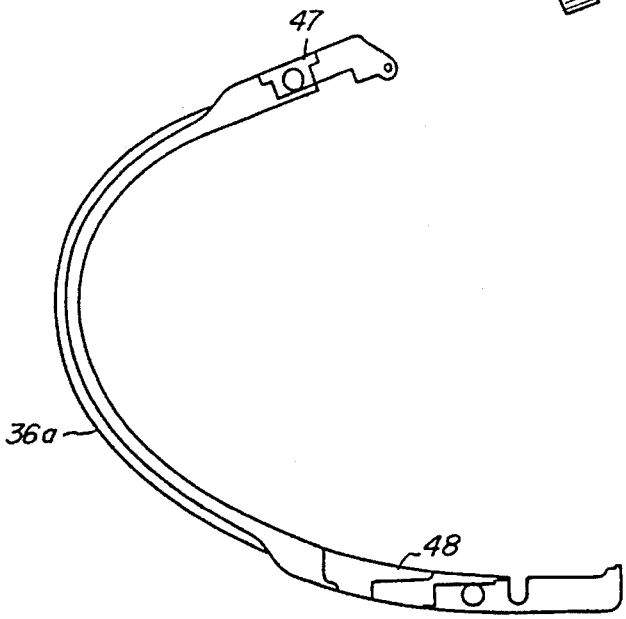
FIG. 14 is a plan view of a larger-radius-of-curvature panel of the tag fastener magazine.
Figure 18:
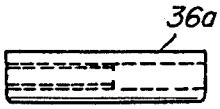
FIG. 18 is an end view of the larger-radius-of-curvature panel at the side of the case cover.
Figure 16:
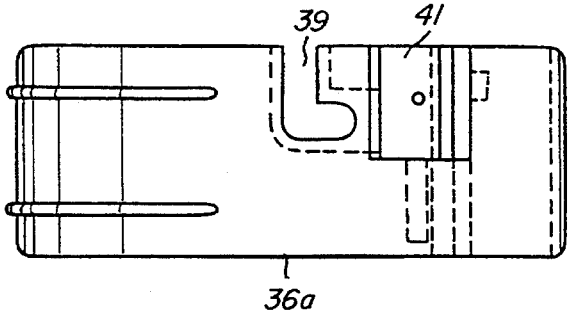
FIG. 16 is a schematic diagram of the larger-radius-of-curvature panel viewed from another side where it is coupled to a case cover.
Figure 20:
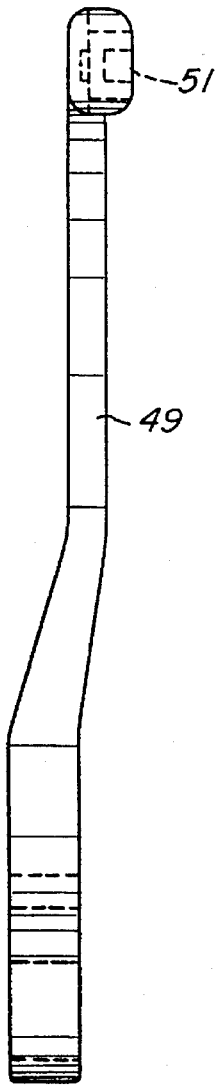
FIG. 20 is its side view.

One of the cover halves of the case cover 20 has a recess in the top of its forward portion, defining an open space for a magazine 36. The magazine 36 is detachably mounted on a set pin 35 having a locking flange at the free end thereof and mounted on the inside of the forward portion of the other cover half. The afore mentioned tag fastener assembly is loaded in the magazine 36. The magazine 36 is formed by a pair of curved larger and smaller radius-of-curvature panels **36*a* and 36*b* (hereinafter referred to as simply as first and second curved panels, respectively, for the sake of brevity). The second curved panel 36*b* is pivotally secured by a pin 37 to the free end of the first curved panel 36*a*, and the tip of the second curved panel 36*b* is snapped into engagement with the base of the first curved panel 36*a*. In FIG. 9A, reference numeral 38 is an actuating piece of the second curved panel 36*b*. The first curved panel 36*a* has an L-shaped recess 39 as depicted in FIG. 16 for engagement with the afore-mentioned set pin 35**.

Figure 8:
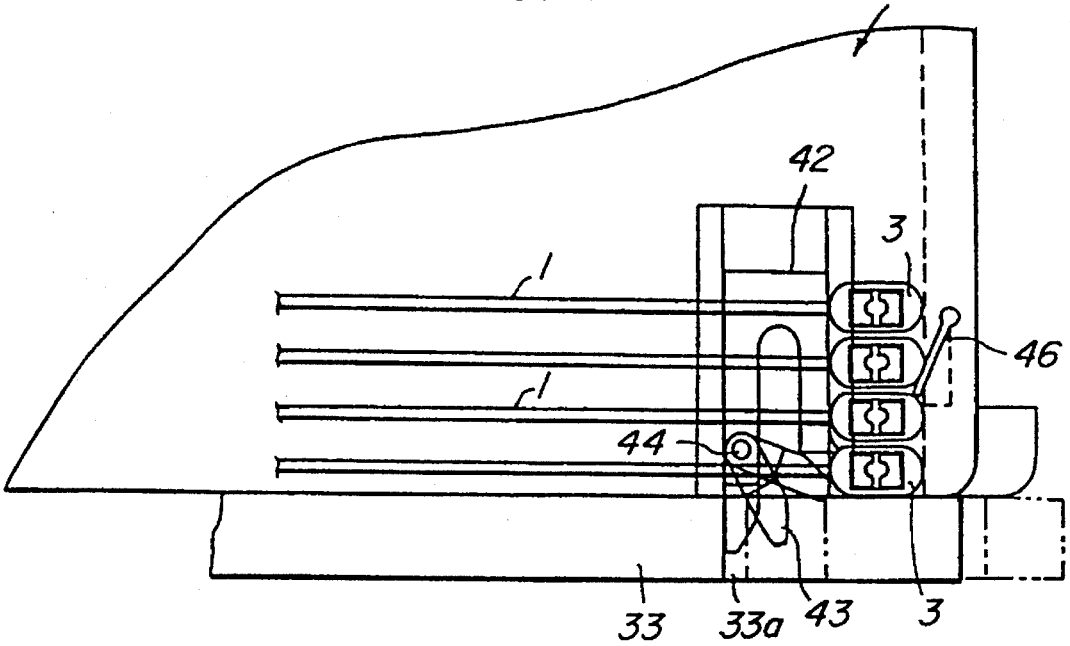
FIG. 8 is a diagram schematically showing another part of the tag fastener feed mechanism.
Figure 31:
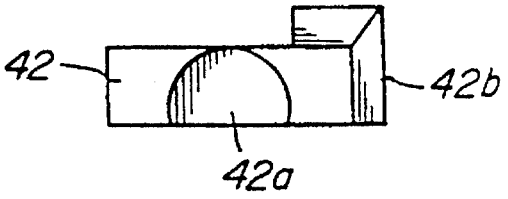
FIG. 31 is its plan view.
Figure 30:
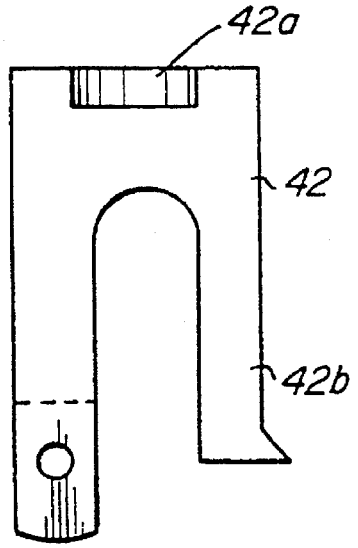
FIG. 30 is a front view of a slide cam of the magazine.
Figure 32:
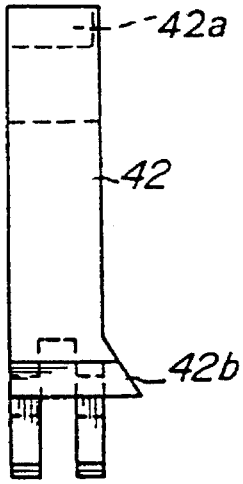
FIG. 32 is its side view.
Figure 33:
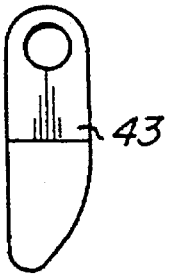
FIG. 33 is a front view of another slide cam.
Figure 34:
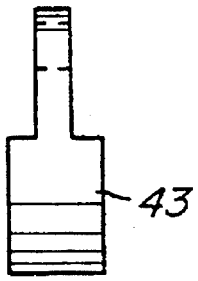
FIG. 34 is its side view.
Figure 36:
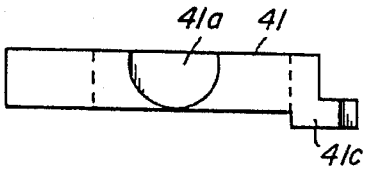
FIG. 36 is its plan view.
Figure 35:
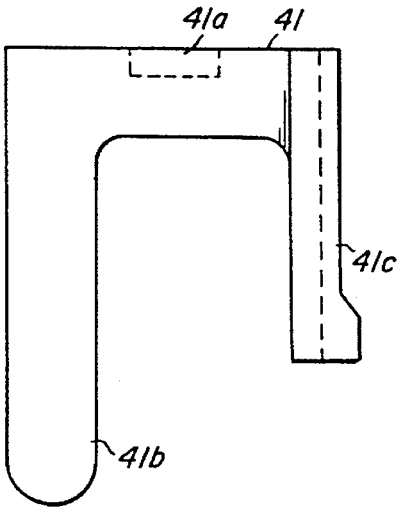
FIG. 35 is a front view of another slide cam.
Figure 37:
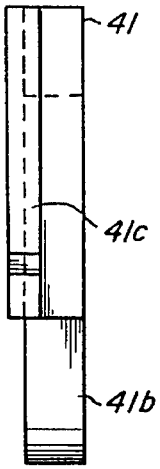
FIG. 37 is its side view.

The first curved panel **36*a* of the magazine 36 has a pair of slide cams 41 and 42 which are pressed down by a spring 40 to feed the tag fastener assembly loaded in the magazine 36. The one slide cam 41 is disposed near the base portion of the magazine 36 and has a spring shoe 41*a* made in its top and legs 41*b* and 41*c* as shown in FIGS. 35 through 37. The leg 41*b* of the slide cam 41 is urged upward by the slide bar 33 in operation. The other slide cam 42 is disposed near the free end of the first cur ed panel 36*a* and has a spring shoe 42*a* made in its top and a press leg 42*b* as depicted in FIGS. 30 through 32. Furthermore, the slide cam 42 has pivotally secured thereto a cam 43 by a pin 44 which is turned into and out of a guide hole 33*a* made in the slide bar 33 as shown in FIGS. 8 and 9. In FIGS. 6 through 9, reference numerals 45 and 46 denote stoppers which prevent the tag fastener assembly from sliding. The first curved panel 36*a* of the magazine 36 has portions for receiving the socket 3 and the plug-in part 6 of the tag fastener, respectively, as indicated by 47 and 48 in FIG. 14**.

Figure 19:
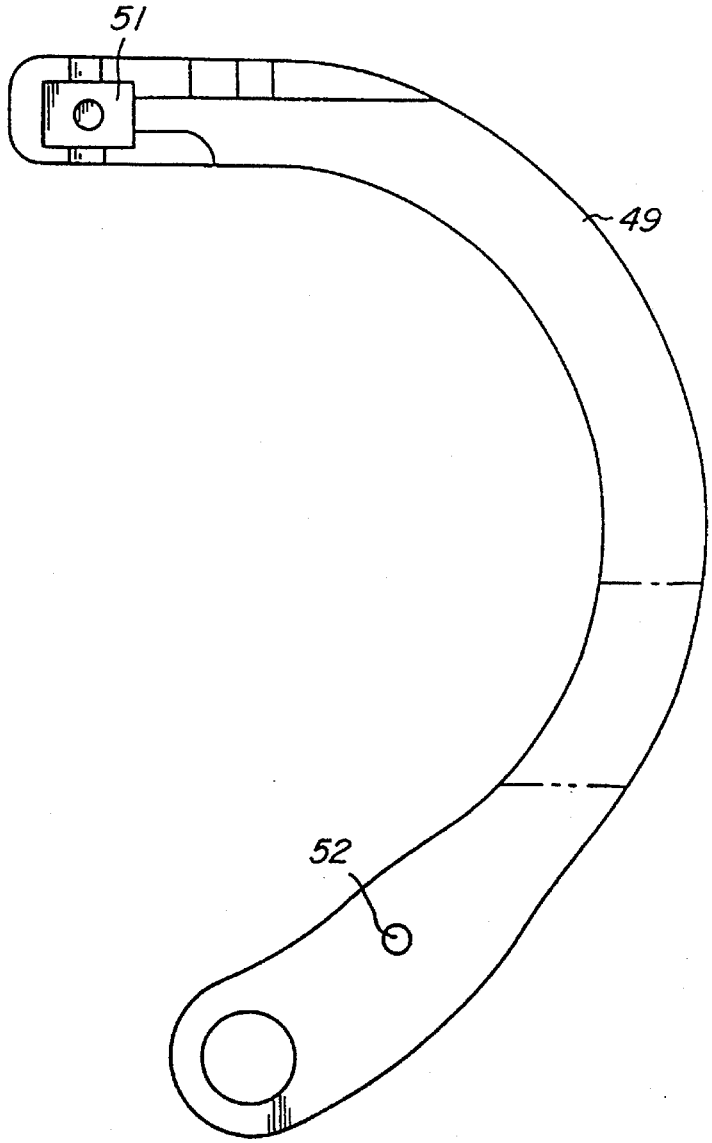
FIG. 19 is a plan view of a feed arm.
Figure 22:
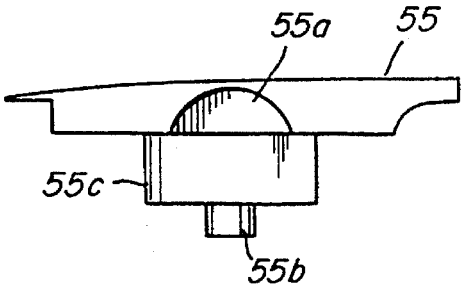
FIG. 22 is its plan view.
Figure 21:
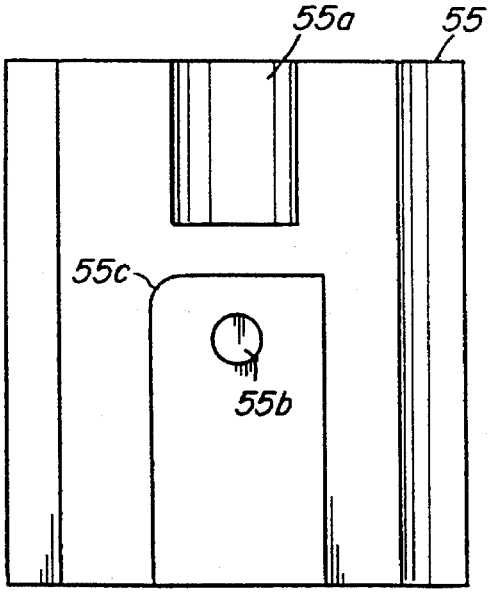
FIG. 21 is a bottom view of an auxiliary cover.
Figure 23:
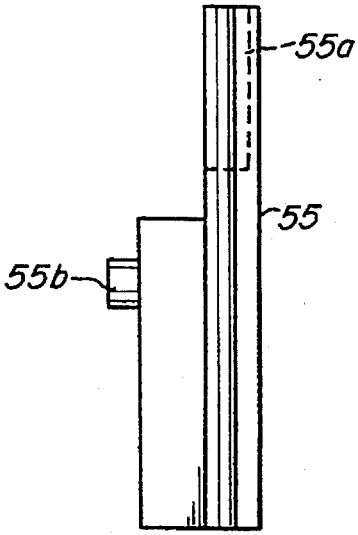
FIG. 23 is its side view.

Reference numeral 49 denotes an arc-shaped rotary feed arm, to which tag fasteners 1 are fed from the magazine 36 one by one. The rotary feed arm 49 is pivotally secured by a pin 50 to the underside of the magazine 36 and has in the top of its tip end a portion 51 for receiving the socket 3 of the tag fastener 1 as shown in FIG. 19. Moreover, the feed arm 49 has planted thereon a pin 52 near the pivot pin 50 for engagement with a slide cam 53 described below.

The slide cam is operatively associated with the afore-mentioned slide bar 33 and has in its plate portion **53*a* a slit 53*b* for engagement with the above-mentioned pin 52; so that when the slide cam 53 slides in association with the slide bar 33, the pin 52 is pressed to turn the feed arm 49 about the pin 50** in the forward or backward direction.

Figure 25:
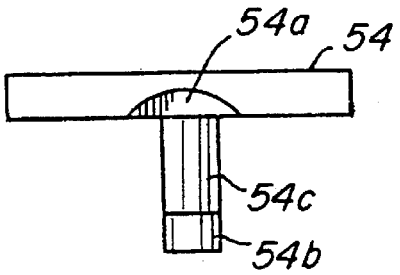
FIG. 25 is its plan view.
Figure 24:
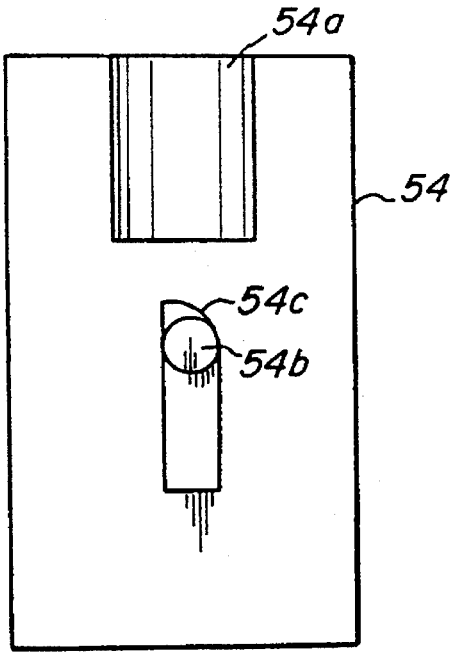
FIG. 24 is a bottom view of another auxiliary cover.
Figure 26:
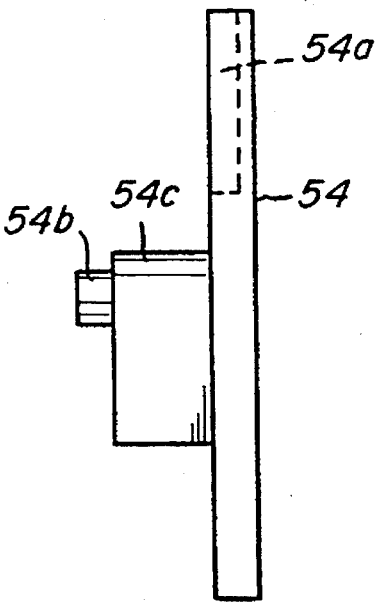
FIG. 26 is its side view.

The magazine 36 further has auxiliary covers 54 and 55 intended to facilitate the operations of the slide cams 42 and 43, respectively. As shown in FIGS. 24 through 26, the auxiliary cover 54 is provided with a cam which has a spring shoe **54*a* for the afore-mentioned spring 40, a pin 54*b* and a rounded portion 54*c*. Similarly, the auxiliary cover 55 has a cam which has a spring shoe 55*a*, a pin 55*b* and a rounded portion 55*c***.

Next, the operation of the tag fastening device of the present invention will be described. When the trigger lever 23 is manually actuated, the swing arm 24 is turned about the pin 25 to push the piston pin 30 forward, while at the same time drivings the slide bar 33 and the slide cam 53. In consequence, the lowermost tag fastener cut off the fastener assembly in the magazine 36 is fed to the rotary feed arm 49 by the slide cams 41, 42 and 43. The rotary feed arm 49 is then turned about the pin 50 to pass the socket 3 of the tag fastener 1 through a hole of a tag and bring it around, for example, a belt loop of trousers and to a position opposite the plug-in part 6 of the same tag fastener 1. Then, the trigger lever 23 is depressed by a further amount, by which the piston pin 30 is further pushed forward, forcing the plug-in part 6 of the tag fastener 1 into the aperture 2 of the socket 3 until it is locked therein. Incidentally, the connecting member 5 is torn off when the rotary feed arm 49 starts to turn and the thin coupling member 10 is torn off by the sliding movement of the piston pin 30; cutters may be provided, if necessary. By allowing the trigger lever 23 to return to its initial position, the slide cams 41, 42 and 43 are activated again to feed the next tag fastener to the rotary feed arm 49.

As described above, according to the present invention, tag fasteners can be attached to goods one after another by one-touch simple operations. Hence, the device of the present invention enhances the efficiency of tag fastening work and reduces the working time, excluding the possibility of workers suffering from pains in their fingertips.

It will be apparent that many modifications and variations may be effected without departing from the scope of the novel concepts of the present invention.

What is claimed is:

1. A tag fastening device comprising:

a case having a part which forms a grip of said tag fastening device;

a magazine detachably mounted on said case, for housing a tag fastener assembly;

a trigger lever pivotally secured by a first pivot pin to said grip on an inside thereof;

a swing arm, pivotally secured by a second pivot pin to said grip on the inside thereof and normally pulled in a direction away from said magazine by spring means to turn about said second pivot pin, urging said trigger lever in a direction away from said grip of said case;

piston pin means normally pulled in said direction away from said magazine by spring means wound thereon, for receiving and guiding a plug-in part of a tag fastener fed from said magazine;

a slide bar operatively associated with said piston pin means, for cutting said tag fastener off said tag fastener assembly loaded in said magazine; and curved rotary feed arm means pivotally secured to said magazine, for receiving and guiding said cut-off tag fastener, after passing it through a hole of a tag, to a position for attachment to an article.

2. The device of claim 1, wherein said spring means are both coil springs.

3. The device of claim 1, wherein said case is formed by a pair of cover halves coupled together.

4. The device of claim 1, wherein said curved rotary feed arm means is pivotally secured to said magazine by a third pivot pin; a slide cam is mounted for movement with said slide bar and has a slit therein; and said curved rotary feed arm means has in the vicinity of said third pivot pin an engaging pin received in said slit made in said slide cam.

5. A tag fastening device comprising:

a case having a part which forms a grip of said tag fastening device;

a magazine detachably mounted on said case, for housing a tag fastener assembly, said magazine being formed by a pair of inner and outer curved panels of different radii of curvature, said inner curved panel having a smaller radius of curvature than said outer curved panel, said inner curved panel being pivotally secured at one end to said outer curved panel;

a trigger lever pivotally secured by a first pivot pin to said grip on an inside thereof;

a swing arm pivotally secured by a second pivot pin to said grip on the inside thereof and normally pulled in a direction away from said magazine by spring means to turn about said second pivot pin, urging said trigger lever in a direction away from said grip of said case;

piston pin means normally pulled in said direction away from said magazine by spring means wound thereon, for receiving and guiding a plug-in part of a tag fastener fed from said magazine;

a slide bar operatively associated with said piston pin means, for cutting said tag fastener off said tag fastener assembly loaded in said magazine; and curved rotary feed arm means pivotally secured to said magazine, for receiving and guiding said cut-off tag fastener, after passing it through a hole of a tag, to a position for attachment to an article.

6. The device of claim 5, wherein said outer curved panel of said magazine has an L-shaped slit for engagement with a set pin which is mounted on said case.

* * * * *